US012173907B2

(12) United States Patent
Imbert et al.

(10) Patent No.: US 12,173,907 B2
(45) Date of Patent: Dec. 24, 2024

(54) FIREPLACE WITH A SUSPENDED HEARTH

(71) Applicant: ATELIER DOMINIQUE IMBERT, Viols le Fort (FR)

(72) Inventors: Dominique Imbert, Viols le Fort (FR); Alexis Guy, Cavaillon (FR); Sylvain Raymond, Cavaillon (FR)

(73) Assignee: Atelier Dominique Imbert, Viols le Fort (FR)

( * ) Notice: Subject to any disclaimer, the term of this patent is extended or adjusted under 35 U.S.C. 154(b) by 384 days.

(21) Appl. No.: 17/771,341

(22) PCT Filed: Oct. 22, 2020

(86) PCT No.: PCT/EP2020/079773
§ 371 (c)(1),
(2) Date: Apr. 22, 2022

(87) PCT Pub. No.: WO2021/078870
PCT Pub. Date: Apr. 29, 2021

(65) Prior Publication Data

US 2023/0228426 A1 Jul. 20, 2023

(30) Foreign Application Priority Data

Oct. 22, 2019 (FR) ..... 1911823
Nov. 19, 2019 (FR) ..... 1912910

(51) Int. Cl.
*F24C 3/02* (2021.01)
*F24C 3/08* (2006.01)
(Continued)

(52) U.S. Cl.
CPC ..... *F24C 3/022* (2013.01); *F24C 3/082* (2013.01); *F24C 5/18* (2013.01); *F24C 15/001* (2013.01); *F24C 15/06* (2013.01); *F24C 15/34* (2013.01)

(58) Field of Classification Search
CPC ..... F24C 15/34; F24C 15/06; F24C 15/001; F24C 5/18; F24C 3/082; F24C 3/022
(Continued)

(56) References Cited

U.S. PATENT DOCUMENTS 967,089 A 8/1910 Wadley
5,931,155 A * 8/1999 Hagner ..... F24B 1/18 126/307 R
2007/0044790 A1 3/2007 Carlo

FOREIGN PATENT DOCUMENTS

EP 1403585 A1 3/2004
ES 1065510 U 9/2007
(Continued)

*Primary Examiner* — Vivek K Shirsat
(74) *Attorney, Agent, or Firm* — Craft Chu PLLC; Andrew W. Chu

(57) ABSTRACT

The fireplace includes a hearth suspended on a support. The hearth is defined laterally by a peripheral wall that is equipped with at least one combustion air inlet. There is a discharge pipe for discharging the combustion gases, that includes a bottom portion secured to a top part of the hearth, and a top portion opposite the bottom portion. The fireplace also includes at least one combustible fluid burner that is arranged in the hearth opposite at least one air inlet and a combustible fluid supply column that extends between a first end connected to a combustible fluid source and a second end connected to at least one burner. The supply column passed down through the discharge pipe from its top portion to its bottom portion and opens in the hearth in order to convey the combustible fluid from the combustible fluid source to at least one burner.

11 Claims, 4 Drawing Sheets

(51) Int. Cl.

| | |
|---|---|
| ***F24C 5/18*** | (2006.01) |
| ***F24C 15/00*** | (2006.01) |
| ***F24C 15/06*** | (2006.01) |
| ***F24C 15/34*** | (2006.01) |

(58) Field of Classification Search
USPC ..... 431/161; 126/500–555
See application file for complete search history.

(56) References Cited

FOREIGN PATENT DOCUMENTS

| | | |
|---|---|---|
| FR | 3013422 A1 | 5/2015 |
| GB | 1382665 A | 2/1975 |

* cited by examiner

FIG. 2
CROSS-SECTION A-A
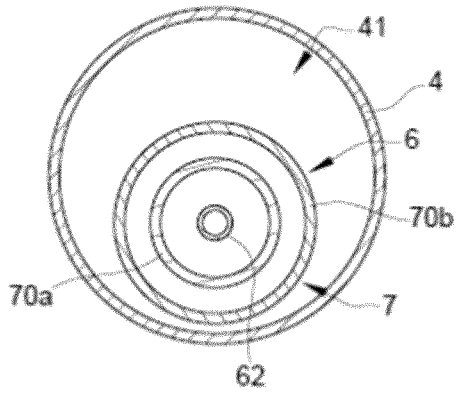
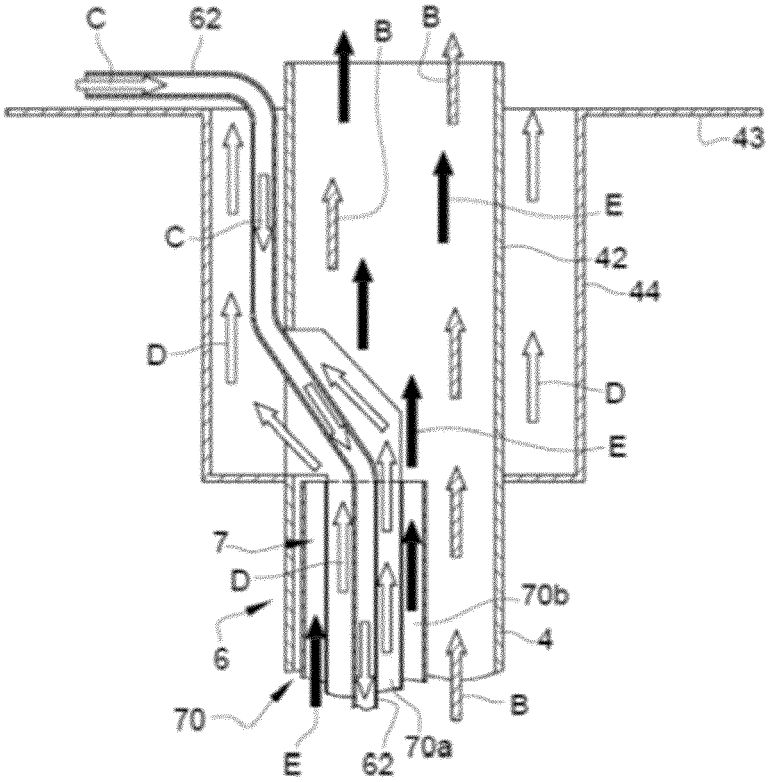
FIG. 3

FIREPLACE WITH A SUSPENDED HEARTH

CROSS-REFERENCE TO RELATED APPLICATIONS

See Application Data Sheet.

STATEMENT REGARDING FEDERALLY SPONSORED RESEARCH OR DEVELOPMENT

Not applicable.

THE NAMES OF PARTIES TO A JOINT RESEARCH AGREEMENT

Not applicable.

INCORPORATION-BY-REFERENCE OF MATERIAL SUBMITTED ON A COMPACT DISC OR AS A TEXT FILE VIA THE OFFICE ELECTRONIC FILING SYSTEM (EFS-WEB)

Not applicable.

STATEMENT REGARDING PRIOR DISCLOSURES BY THE INVENTOR OR A JOINT INVENTOR

Not applicable.

BACKGROUND OF THE INVENTION

1. Field of the Invention

The present invention belongs to the field of fireplaces, and more specifically to the field of decorative fireplaces.

In particular, the present invention relates to a fireplace comprising a suspended hearth, combustion of which is affected by means of a combustible fluid.

2. Description of Related Art Including Information Disclosed Under 37 CFR 1.97 and 37 CFR 1.98

As is recognized scientifically, a fireplace with an open hearth has various drawbacks, firstly, it offers a low thermal energy generation efficiency of between 15% and 20%, and in addition an open hearth produces incomplete combustion of wood, which leads to significant emissions of fine particle pollutants. The open hearth assists the emission of these particles both in the dwelling and in the atmosphere via the discharge pipe. These fine particles constitute a significant health and environmental risk. Moreover, fireplaces with open hearths increase the risk of fire in the room in which they are installed.

These drawbacks have led to legislative changes particularly in Europe which aim to restrict or even prohibit the use of fireplaces with open hearths.

Decorative iconic fireplaces with suspended hearths exist at present. This type of fireplace is made up, on the one hand, of an open hearth which has an elegant esthetic shape, and on the other hand, of a discharge pipe for the combustion gases connected to a top portion of the open hearth. The discharge pipe also acts as a suspension element for the hearth relative to a support which is usually formed by a ceiling.

Some of these decorative iconic fireplace models have a hearth of a particular shape, such as an oblate shape.

Moreover, these hearths usually comprise an opening that matches their shape and therefore complicates the installation of a window in order to transform such a hearth into a closed or inserted hearth.

Having regard to these problems, the applicant has developed a technical solution that allows the production or use of decorative iconic fireplaces to continue while overcoming the drawbacks of fireplaces with open wood-burning hearths.

BRIEF SUMMARY OF THE INVENTION

Accordingly, the present invention relates to a fireplace comprising:

- a hearth suspended on a support, the hearth being delimited laterally by a peripheral wall that is equipped with at least one combustion air inlet, and
- a discharge pipe for discharging the combustion gases, the discharge pipe being secured to a support and comprising a bottom portion secured to a top part of the hearth, and a top portion opposite the bottom portion.

The fireplace according to the invention is characterized in that it comprises:

- at least one combustible fluid burner that is arranged in the hearth opposite at least one air inlet, and
- a combustible fluid supply column that extends between a first end connected to a combustible fluid source and a second end connected to at least one burner, the supply column passing down through the discharge pipe from its top portion to its bottom portion and opening in the hearth in order to convey the combustible fluid from the combustible fluid source to at least one burner.

The use of a combustible fluid burner does not produce fine particles due to the incomplete combustion of a combustible solid. In this respect, converting a wood-burning fireplace into a fireplace that uses a combustible fluid allows the health and energy drawbacks of an open wood-burning hearth to be overcome. Moreover, to preserve the esthetic qualities of iconic models, the combustible fluid supply column is at least partly incorporated in the discharge pipe. In addition, according to the invention, the discharge pipe preferably constitutes the only suspension element for the hearth.

According to a first characteristic of the invention, the supply column comprises a supply pipe and insulation means, the insulation means encircling the supply pipe between each end of the supply column. The insulation means allow the supply column to be maintained at a temperature below a given threshold. Above this threshold, the combustible fluid could be liable to catch fire in the supply pipe.

In particular, the insulation means comprise at least one heat exchanger which encircles the supply pipe, the heat exchanger extends at least between each end of the supply column. Preferably, the insulation means comprise at least two heat exchangers, a first heat exchanger encircling the supply pipe, whilst a second heat exchanger encircles the first heat exchanger, and each heat exchanger extends at least between each end of the supply column.

According to the invention, the two heat exchangers are arranged concentrically. This configuration allows the first heat exchanger to be homogeneously insulated.

Moreover, the insulation means comprise at least one air intake arranged in the region of the hearth, the intake supplying at least one heat exchanger from outside the hearth and generating a rising flow of air within the heat exchanger.

The heat exchangers are preferably air heat exchangers. This configuration therefore generates a rising dual flow of air which helps maintain the supply pipe at a temperature below a given threshold.

According to a second characteristic of the invention, the fireplace comprises, on the one hand, an attachment plate securing the supply pipe to a support, and on the other hand, a sleeve secured to the attachment plate, the sleeve encircling the discharge pipe over a given distance and diffusing the warmed air.

According to a third characteristic of the invention, the hearth is mounted rotating relative to the discharge pipe and/or to the supply column which extends to a base of the hearth, the base of the hearth delimiting the bottom of the hearth. Accordingly, the fireplace comprises a plate arranged in the base of the hearth, the plate pivoting relative to the base of the hearth and the supply column is mounted secured to this pivot plate. The pivot plate and the base are advantageously perforated to allow an intake of air towards the supply column.

According to a fourth characteristic of the invention, the discharge pipe is secured to the support through its top portion, the discharge pipe thus acting as a suspension element for the hearth relative to the support.

BRIEF DESCRIPTION OF THE SEVERAL VIEWS OF THE DRAWINGS

Other special features and advantages will appear in the detailed description that follows of a non-limiting embodiment of the invention illustrated by the accompanying FIGS. 1 to 3.

FIG. 2 is a schematic view of an illustration of a transverse cross section A-A of the discharge pipe of the fireplace with a suspended hearth of FIG. 1.

FIG. 3 is a schematic view of an illustration in longitudinal cross section of a top portion of the discharge pipe of a fireplace as in FIG. 1 with the various flows of gas illustrated.

DETAILED DESCRIPTION OF THE INVENTION

As illustrated in FIGS. 1 to 6, the present invention relates to a fireplace 1 which comprises a hearth 2 suspended from a support 3. In general, the support 3 may be formed by a wall, a partition, a ceiling, a floor, a ceiling fixture, etc. In the case of a ceiling, a floor or a ceiling fixture, such a fireplace 1 may be positioned close to a wall or in front of a glass wall, or alternatively in the middle of a room. Thus, this type of fireplace 1 has a decorative esthetic appearance and also allows heating to be provided to the room in which it is installed.

To fulfil a decorative function, the hearth 2 may have a particular shape. In the example in FIGS. 1, 3 and 6, the hearth 2 is oblate in shape. However, the hearth 2 may take all sorts of three-dimensional geometric forms such as a quadrangular, spherical, pyramidal or cylindrical form, etc.

Figure 1:
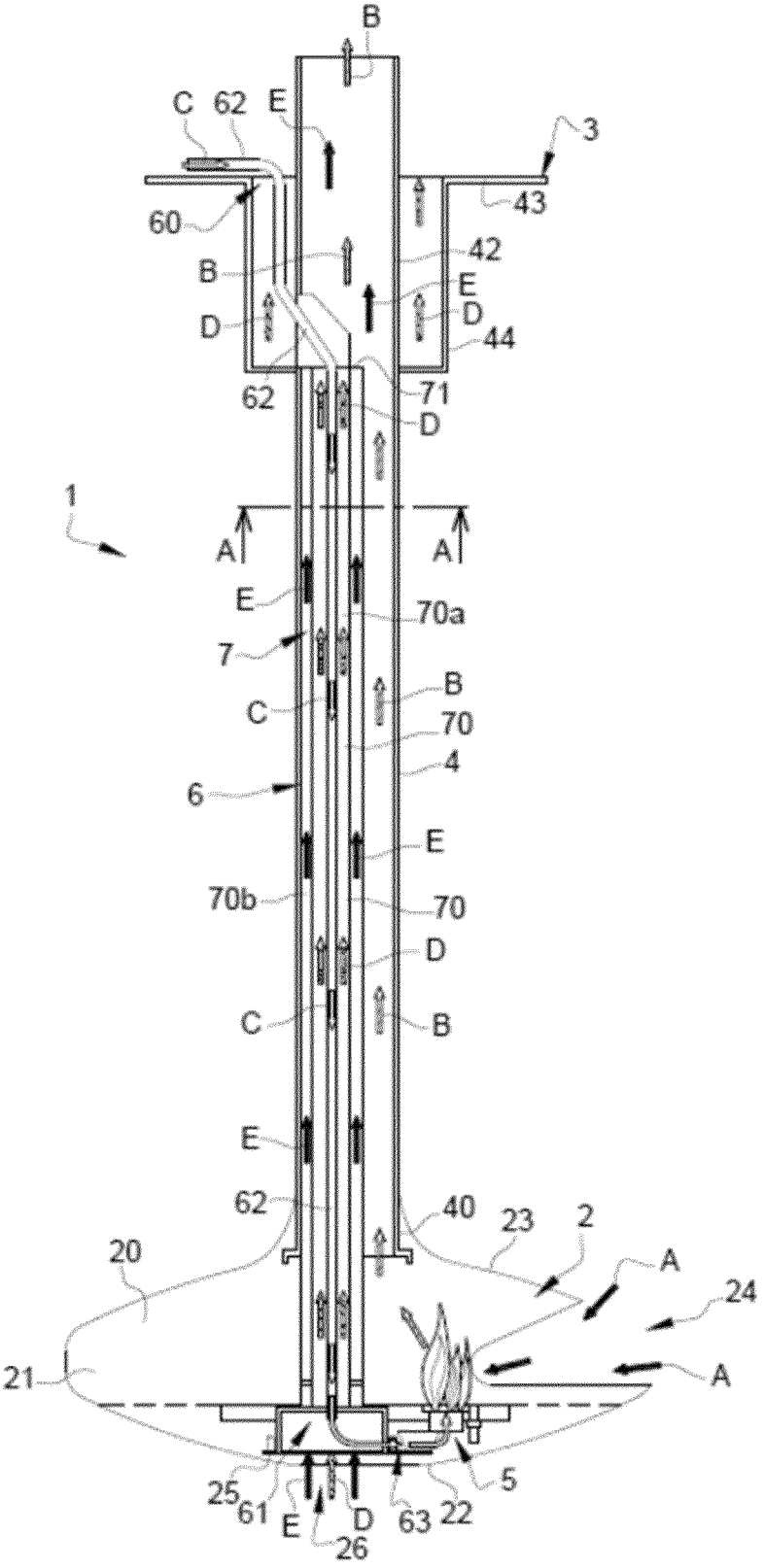
FIG. 1 is a schematic view of an illustration of a longitudinal cross section of a fireplace with a suspended hearth according to an embodiment of the invention.

In the example shown in FIG. 1, the hearth 2 is formed by an enclosure 20. The enclosure 20 comprises a peripheral wall 21 which laterally delimits the hearth 2. The enclosure 20 also comprises a base 22 which delimits the bottom of the hearth 2. As the fireplace 1 is suspended, the base 22 of the hearth 2 is at a given distance from the floor. Preferably, the base 22 never touches the floor of the room. Finally, the enclosure 20 comprises a top wall 23 which delimits the top of the hearth 2. The top wall 23 belongs to a top portion of the hearth 2. Meanwhile, the base 22 belongs to a bottom portion of the hearth 2.

The peripheral wall 21 is equipped with at least one air inlet 24. The air A coming from the air inlet serves as an oxidizer for the combustion process. In this example, the air inlet is formed by an opening 24 arranged in the peripheral wall 21. This opening 24 defines the front face of the hearth 2. In this case, the opening 24 is wide open. However, according to a variant of the invention that has not been illustrated, it is possible to provide means for complete or partial closure in the region of this opening 24 in order to restrict access to the hearth 2. The closure means can preferably be opened and re-closed. As an indication, the closure means may for example be formed by a window or a grating.

The fireplace 1 also comprises a discharge pipe 4. In this example, the discharge pipe 4 is cylindrical. Preferably, the discharge pipe 4 is made of a non-ductile material that has heat conduction properties. As an indication, it is possible to produce the discharge pipe 4 in a metal or metal alloy such as steel, cast iron, etc.

The discharge pipe 4 ensures in particular the discharge of the combustion gases B to the outside of the room. Accordingly, the discharge pipe 4 comprises a bottom portion 40 secured to the top portion of the hearth 2. Of course, the discharge pipe 4 comprises an opening 41 which communicates with the enclosure 20 in the region of the junction between the discharge pipe 4 and the hearth 2. The combustion gases B escape from the hearth in a rising flow (illustrated in FIGS. 1 and 3).

Moreover, the discharge pipe 4 comprises a top portion 42. The top portion 42 is opposite the bottom portion 40. The top portion 42 is secured to the support 3. In this example, the top portion 42 is secured to the support through an attachment plate 43. In the example illustrated in FIGS. 4 and 5, the attachment plate 43 is annular in shape. In practice, the attachment plate 43 may be secured mechanically or by welding to the discharge pipe 4.

Figure 4:
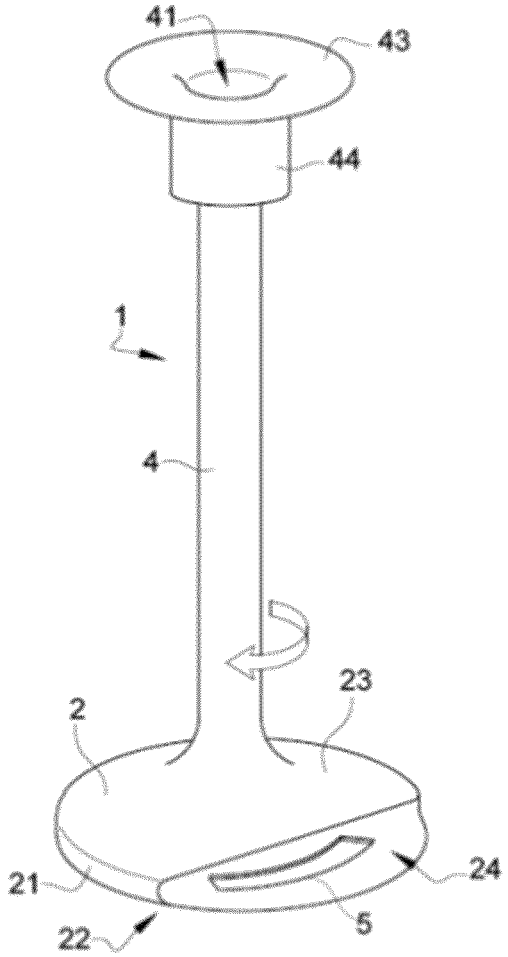
FIG. 4 is a perspective view of an illustration of a fireplace with a suspended hearth according to an embodiment of the invention.
Figure 5:
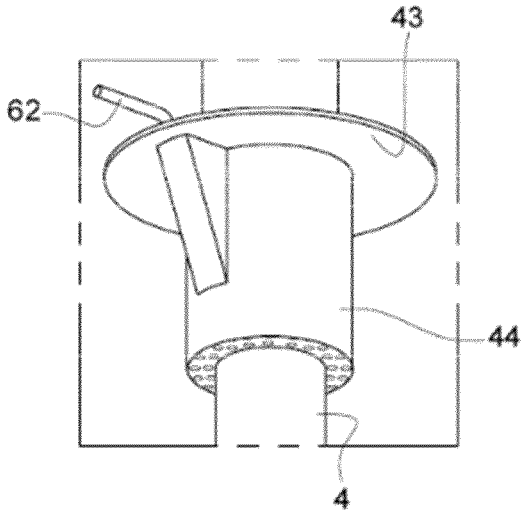
FIG. 5 is a schematic view of an illustration of an attachment plate for the fireplace of FIG. 4.

As illustrated in FIGS. 4 and 5, the fireplace 1 also comprises a sleeve 44 secured to the attachment plate 43. The sleeve 44 encircles the discharge pipe 4. In this case, the sleeve 44 extends over a given distance from the plate 43 in the direction of the bottom portion 40 of the discharge pipe 4. Preferably, the sleeve 44 comprises a hollow body which extends annularly between the peripheral wall of the discharge pipe 4 and the outer wall of the sleeve 44.

In the example described in FIGS. 1 to 6, the discharge pipe 4 acts as a suspension element for the hearth 2 relative to the support 3. The discharge pipe 4 therefore extends down from the support 3 to the hearth 2. Preferably, the discharge pipe 4 extends longitudinally between the support 3 and the hearth 2. However, depending on the model of fireplace 1 and/or the type of installation, it is possible for the discharge pipe 4 not to extend in a rectilinear fashion.

Moreover in order to discharge the combustion gases B outside the room and/or the building, the discharge pipe 4 is extended by an exhaust pipe to the outside of the room and/or building.

The fireplace 1 comprises at least one combustible fluid burner 5. Preferably, the burner 5 is configured to burn combustible fluid C such as town gas, propane, butane, etc. However, it is also possible to use a burner configured to burn ethanol or bioethanol. In this example, the burner 5 is arranged in the hearth 2. In particular, the burner 5 is arranged opposite the opening 24. Thus, the burner 5 uses the air A coming from the opening 24 as an oxidizer. Moreover, this configuration allows the blazing of the flames produced by the burner 5 to be diffused through the opening 24 within the room where the fireplace 1 is installed.

Figure 6:
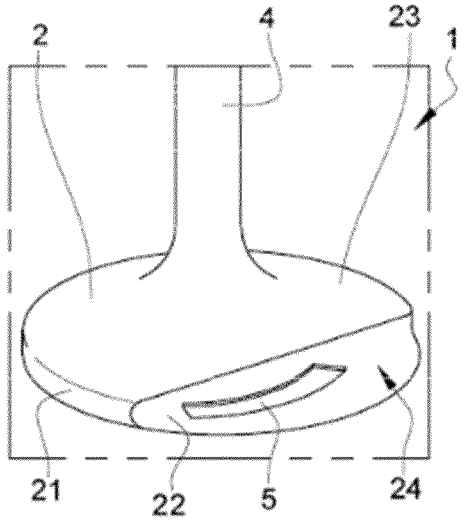
FIG. 6 is a schematic view of an illustration of the hearth of the fireplace of FIG. 4.

In the example in FIG. 6, the fireplace 1 comprises a curved burner 5. In this case, the curvature of the burner 5 follows the curvature of the enclosure 20 and of the opening 24.

The use of a burner 5 for a combustible fluid C allows the fine particle emissions that are linked to the incomplete combustion of wood to be reduced. In this respect, the burner 5 for combustible fluid C helps overcome the drawbacks of the wood-burning fireplace described in the introduction to this document.

As illustrated in FIGS. 1 to 3, the fireplace 1 comprises a supply column 6. The supply column 6 is in particular configured to supply the burner 5 with combustible fluid. Accordingly, the supply column 6 extends between a first end 60 connected to a combustible fluid source and a second end 61 connected to at least one burner 5. In this case, the source of combustible fluid C is situated upstream of the support 3. The combustible source may consist of a local storage tank such as a gas cylinder. However, preferably, the source of combustible fluid C is a public supply network, for example a network supplying town gas.

In this example, the supply column 6 is arranged passing down through the discharge pipe 4. More precisely, the supply column 6 extends at least in part within the opening 41 of the discharge pipe 4. As illustrated in FIGS. 1 to 3, the supply column 6 extends along an axis that is radially offset relative to the central axis of the discharge pipe 4. In this case, the supply column 6 extends initially within the sleeve 44. The supply column 6 then extends longitudinally from the top portion 42 to the bottom portion 40 of the discharge pipe 4. Preferably, the supply column 6 extends beyond the bottom portion 40 and opens in the hearth 2. Finally, the supply column 6 extends to a plate 25 arranged in the region of the base 22 of the hearth 2. In the region of this plate, 25, the supply column 6 is connected to at least one burner 5.

Advantageously, the fact that the supply column 6 extends within the discharge pipe 4 helps provide a compact and esthetic technical solution for supplying the burner 5 with combustible fluid.

In the example illustrated in FIGS. 1 to 3, the supply column 6 comprises a supply pipe 62 which extends from the combustible fluid source to at least one burner 5. In particular, the supply pipe 62 passes successively through the attachment plate 43, the sleeve 44 and the supply column 6 to the plate 25. In the region of the plate 25, the supply pipe 62 is extended by a flexible supply coupling 63 which is connected to at least one burner 5. Thus, the combustible fluid passes through the supply column 6 in a downward flow C to the burner 5. Moreover, the flexible supply coupling 63 is connected, on the one hand, to the supply pipe 62 and, on the other hand, to at least one burner 5 through a sealed mechanical connection. For example, this sealed mechanical connection may be produced by gland nuts which maintain the fittings in position during the rotation of the hearth 2.

The supply pipe 62 may be formed by a cylindrical pipe made of a non-ductile material covered with an insulating polymer material. For example, the supply pipe 62 is made of a metal material such as stainless steel or aluminum. The supply pipe 62 may convey combustible gas such as town gas, propane, butane, etc.

Advantageously, the supply column 6 comprises insulation means 7. In this case, the insulation means 7 encircle the supply pipe 62 between each end 60, 61 of the supply column 6. In this respect, the insulation means 7 allow the supply pipe 62 to be insulated from the combustion gases B which circulate in the discharge pipe 4 in an upward flow. This is because the combustion gases B can generally reach temperatures of between 150° C. and 300° C.

However, at such a temperature, the combustible fluid is likely to catch fire through a simple transfer of the thermal energy of the rising combustion gases B. However, the insulation means 7 allow the transfer of thermal energy to be reduced. This is because the insulation means 7 maintain the supply pipe 62 at a temperature below a given threshold temperature. More precisely, the insulation means 7 maintain the supply pipe 62 at a temperature of less than 60° C. Preferably, the insulation means 7 allow the supply pipe 62 to be kept at a temperature of less than 50° C.

With this in mind, the insulation means 7 comprise at least one heat exchanger 70. The heat exchanger 70 encircles the supply pipe 62. Thus, the heat exchanger 70 insulates the supply pipe 62 from the combustion gases B. In this example, the heat exchanger 70 extends at least between each end 60, 61 of the supply column 6. In practice, the heat exchanger 70 extends from the plate 25 positioned in the hearth 2 to the sleeve 44. In fact, the heat exchanger 70 passes successively through the hearth 2 and the discharge pipe 4.

Preferably, as illustrated in FIGS. 1 to 3, the insulation means 7 comprise at least two heat exchangers 70, **70*a*, 70*b*. In this advantageous configuration, a first heat exchanger 70*a* encircles the supply pipe 62. At the same time, a second heat exchanger 70*b* encircles the first heat exchanger 70*a*. It should be noted that the peripheral wall of the second heat exchanger 70*b* laterally delimits the supply column 6 within the hearth 2 but also within the discharge pipe 4**.

The heat exchangers 70, **70*a*, 70*b* are fitted inside each other. Moreover, the supply pipe 62 is fitted in the first heat exchanger 70*a*. This configuration allows the insulation of the supply pipe 62** to be optimized.

In addition, in the example illustrated in FIG. 2, the two heat exchangers 70, **70*a*, 70*b* are arranged concentrically. Advantageously, the second heat exchanger 70*b* allows the first heat exchanger 70*a* to be cooled. The supply pipe 62 can therefore come in contact with the walls of the first heat exchanger 70*a* without danger. In this example, the supply pipe 62 consists of a flexible, semi-rigid pipe. The concentric arrangement of the heat exchangers ensures homogeneous insulation of the peripheral wall which radially delimits the first heat exchanger 70*a***.

In this example, each heat exchanger 70, **70*a*, 70*b*** is formed by a pipe. This pipe is made preferably of a non-ductile material such as a metal material. For example, the pipe may be made of stainless steel, aluminum, etc. Moreover, each pipe may be covered with a high-temperature resistant insulating coating. For example, it is possible to use a material such as ceramic cloth, glass fiber, microtherm, elastomer, etc.

As an example, the first heat exchanger 70*a* may have a cross section measuring at least 1.5 times more than the cross section of the supply pipe 62. At the same time, the second heat exchanger 70*b* may have a cross section measuring at least 1.3 times more than the cross section of the first heat exchanger 70*a*.

In the example shown in FIGS. 1 to 3, each heat exchanger 70, 70*a*, 70*b* is an air heat exchanger. In this context, the insulation means 7 comprise at least one air intake. In this example, the air intake is arranged in the region of the hearth 2. More precisely, this air intake is arranged in the region of the plate 25. Accordingly, the platform 25 is perforated.

Similarly, the base 22 also comprises at least one air intake 26 which is advantageously arranged on the same axis as the air intake(s) of the insulation means 7. These air intakes 26 supply at least one heat exchanger 70, 70*a*, 70*b* from outside the hearth 2. These characteristics help generate a rising flow of air D, E within at least one heat exchanger 70, 70*a*, 70*b*. This rising flow of air is referred to as cool air as it comes directly from outside the hearth 2. In practice, each heat exchanger 70, 70*a*, 70*b* has an air intake in the region of the plate 25. This configuration generates a dual flow of cool air D, E within the supply column 6. The dual flow of cool air D, E helps ensure optimal insulation of the supply pipe 62.

Table 1 below compares the temperature of the supply pipe 62 measured at a plurality of heights for, on the one hand, a first embodiment of the invention known as a single-flow configuration in which the supply column 6 is equipped with a single heat exchanger 70, 70*a*, 70*b* and, on the other hand, a second embodiment known as a dual-flow configuration, in which the supply column 6 comprises two heat exchangers 70, 70*a*, 70*b*.

TABLE 1

| Height of the supply column (mm) | Single-flow configuration Supply pipe temperature (° C.) | Dual-flow configuration Supply pipe temperature (° C.) |
|---|---|---|
| 5 | 41 | 21 |
| 55 | 41 | 21 |
| 105 | 43 | 20 |
| 155 | 55 | 21 |
| 205 | 56 | — |
| 255 | — | 21 |
| 305 | 67 | — |
| 355 | — | 21 |
| 405 | 72 | — |
| 455 | — | 22 |
| 505 | 73 | — |
| 555 | — | 22 |
| 605 | 73 | — |
| 705 | 73 | — |
| 755 | — | 23 |
| 805 | 72 | — |
| 905 | 72 | — |
| 955 | — | 24 |
| 1005 | 72 | — |
| 1115 | — | 25 |
| 1355 | — | 24 |

According to these results, in a single-flow configuration, the temperature of the supply pipe 62 may vary between 41° C. and 72° C. whereas the dual-flow configuration allows the variation in temperature of the supply pipe 62 to be limited to between 21° C. and 24° C.

Thus, the dual-flow configuration allows the temperature of the supply pipe 62 to be maintained at more than 30° C. below the threshold of 60° C. Because of this, the dual-flow configuration allows the risk of the combustible fluid C catching fire through a thermal energy transfer from the combustion gases B to be reduced, or even eliminated.

As illustrated in FIG. 3, at least one heat exchanger 70, 70*a*, 70*b* comprises an exhaust outlet 71. This exhaust outlet 71 is open in the discharge pipe 4. In particular, the exhaust outlet 71 is arranged close to the first end 60 of the discharge column 4. In this example, it is the second heat exchanger 70*b* that comprises an exhaust outlet 71 open in the top portion of the opening 41 of the discharge pipe 4. Thus, the cool air E enters into the second heat exchanger 70*b* via the air intake, passes up through the supply column 6 to the exhaust outlet 71. In the region of the exhaust outlet 71, the rising air E is mixed with the combustion gases B and is then discharged to the outside by the discharge pipe.

According to the invention, each heat exchanger 70, 70*a*, 70*b* extends at least between each end 60, 61 of the supply column 6. More precisely, the first heat exchanger 70*a* extends from the plate 25 to the sleeve 44. The second heat exchanger 70*b* on the other hand extends from the plate 25 to the junction between the supply column 6 and the sleeve 44.

As illustrated in FIGS. 1 and 3, the first heat exchanger 70*a* opens in the sleeve 44. The sleeve 44 which comprises openings arranged in its peripheral wall. Thus, the sleeve 44 diffuses the warmed air which has previously passed through the first heat exchanger 70*a* from the platform 25. Advantageously, this creates a natural air circulation within the first heat exchanger 70*a*. The cool air D which enters into the first heat exchanger 70*a* in the region of the air intake. When entering in the region of the air intake, the cool air D is at ambient temperature. While passing through the first heat exchanger 70*a*, the cool air D is warmed to be discharged from the sleeve 44 to the room at a temperature of between 35° C. and 40° C. By diffusing warmed air in the region of the ceiling of the room, this helps diffuse the temperature produced by the combustion homogeneously. This characteristic improves the thermal comfort of the room in which the fireplace 1 is installed.

As illustrated in FIG. 4, the hearth 2 is mounted rotating relative to the discharge pipe 4. To this end, the hearth 2 is connected to the discharge pipe by a rotating mechanical connection such as a cylinder/cylinder pivot linkage. Moreover, the hearth 2 may also be mounted rotating relative to the supply column 6. Accordingly, the plate 25 is mounted pivoting relative to the base 22 of the hearth 2. To do this, the plate 25 may be engaged in a rotating mechanical linkage. For example, the rotating mechanical linkage may be formed by a revolving plate with ball bearings, or a disc cooperating in a friction bearing, etc.

We claim:

1. A fireplace, comprising:

a support;

a hearth being suspended on said support, and being delimited laterally by a peripheral wall equipped with at least one combustion air inlet;

a discharge pipe being secured to said support and having a bottom portion secured to a top part of said hearth, and a top portion opposite said bottom portion;

at least one combustible fluid burner being arranged in said hearth opposite the combustion air inlet; and a combustible fluid supply column having a first end and a second end opposite said first end and connected to at least one burner, wherein said combustible fluid supply column passes down through said top portion to said bottom portion of said discharge pipe and an opening in said hearth so as to convey a combustible fluid from a combustible fluid source through said first end of said combustible fluid supply column connected to the combustible fluid source to the combustible fluid burner-connected to said second end of said combustible fluid supply column.

2. The fireplace, according to claim 1, wherein said combustible fluid supply column comprises a supply pipe and insulation means, wherein the insulation means encircles said supply pipe between said first end and said second end of said combustible fluid supply column.

3. The fireplace, according to claim 2, wherein the insulation means comprises a heat exchanger extending between said first end and said second end of said combustible fluid supply column.

4. The fireplace, according to claim 2, wherein the insulation means comprises: a first heat exchanger encircling said supply pipe; and a second heat exchanger encircling said first heat exchanger, wherein said first heat exchanger extends between said first end and said second end of said combustible fluid supply column, and wherein said second heat exchanger extends between said first end and said second end of said combustible fluid supply column.

5. The fireplace, according to claim 4, wherein said first heat exchanger and said second heat exchanger are arranged concentrically.

6. The fireplace, according to claim 3, wherein the insulation means further comprises at least one air intake arranged in said hearth and connected to said heat exchanger so as to generate a rising flow of air within heat exchanger from air outside said hearth.

7. The fireplace, according to claim 2, wherein said support is comprised of:

an attachment plate being secured to said supply pipe, and a sleeve secured to said attachment plate, said sleeve encircling said discharge pipe over a given distance so as to diffuse warmed air.

8. The fireplace, according to claim 1, wherein said hearth is further comprised of a base so as to define a bottom of said hearth, said hearth being rotatably mounted to said discharge pipe.

9. The fireplace, according to claim 8, further comprising: a pivot plate secured to said combustible fluid supply column and arranged in said hearth so as to rotate relative to said base.

10. The fireplace, according to claim 8, wherein said pivot plate and said base are perforated so as to allow an intake of air towards said combustible fluid supply column.

11. The fireplace, according to claim 1, wherein said top portion of said discharge pipe is secured to said support so as to suspend said hearth by said support.

* * * * *